US011499745B1

(12) United States Patent
Salter et al.

(10) Patent No.: US 11,499,745 B1
(45) Date of Patent: Nov. 15, 2022

(54) VEHICLE WATER HEATING SYSTEM AND METHOD

(71) Applicant: Ford Global Technologies, LLC, Dearborn, MI (US)

(72) Inventors: Stuart C. Salter, White Lake, MI (US); David Brian Glickman, Southfield, MI (US); Paul Kenneth Dellock, Northville, MI (US); Jeffrey Robert Seaman, Brownstown, MI (US); Annette Lynn Huebner, Highland, MI (US); Brian James Andonian, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/243,382

(22) Filed: Apr. 28, 2021

(51) Int. Cl.

| | |
|---|---|
| ***F23H 1/06*** | (2006.01) |
| ***F01P 11/08*** | (2006.01) |
| ***F24H 1/06*** | (2022.01) |

(52) U.S. Cl.
CPC ..... *F24H 1/06* (2013.01); *F01P 11/08* (2013.01); *F01P 2060/04* (2013.01)

(58) Field of Classification Search
CPC ..... F01P 2060/00; F01P 3/20; F24H 1/009; F24H 1/06; F24H 1/122
See application file for complete search history.

(56) References Cited

U.S. PATENT DOCUMENTS

| | | | | |
|---|---|---|---|---|
| 3,381,316 | A * | 5/1968 | Anderson | A47K 3/30 4/597 |
| 4,364,133 | A * | 12/1982 | Gunter | B60P 3/30 296/156 |
| 6,332,580 | B1 * | 12/2001 | Enander | G05D 23/1931 237/12.3 B |
| 10,035,547 | B1 * | 7/2018 | Reyes | A47K 3/28 |
| 10,525,793 | B2 | 1/2020 | Kappner et al. | |
| 2005/0217018 | A1 * | 10/2005 | Ebbe | B60P 3/22 4/616 |
| 2012/0111971 | A1 * | 5/2012 | Chang | F24H 1/08 239/128 |
| 2020/0291623 | A1 * | 9/2020 | Ridell | C02F 1/006 |

FOREIGN PATENT DOCUMENTS

| | | |
|---|---|---|
| DE | 102010051780 | 5/2011 |
| JP | 2007247932 | 9/2007 |
| JP | 4457848 | 2/2010 |
| WO | 2010038919 | 4/2010 |

* cited by examiner

*Primary Examiner* — Long T Tran
(74) *Attorney, Agent, or Firm* — Vichit Chea; Carlson, Gaskey & Olds, P.C.

(57) ABSTRACT

A water heating system for a vehicle includes, among other things, a container and an assembly of a vehicle. The assembly has a thermal energy level that increases as a result of operating the vehicle. The system further includes a path that communicates water back-and-forth between the container and the assembly to increase amount of thermal energy within water that is in the container, and an outlet configured to dispense water from the container for use by a user.

19 Claims, 3 Drawing Sheets

VEHICLE WATER HEATING SYSTEM AND METHOD

TECHNICAL FIELD

This disclosure relates generally to a heating water held within a vehicle water tank.

BACKGROUND

Some vehicles, particularly vehicles used for overlanding and camping, include a water tank. Propane heaters are sometimes used to heat the water. Water taken from the tank can be used for cooking and cleaning.

SUMMARY

A water heating system for a vehicle according to an exemplary aspect of the present disclosure includes, among other things, a container and an assembly of a vehicle. The assembly has a thermal energy level that increases as a result of operating the vehicle. The system further includes a path that communicates water back-and-forth between the container and the assembly to increase amount of thermal energy within the water that is in the container, and an outlet configured to dispense water from the container for use by a user.

In another example of the foregoing system, the assembly is a transaxle.

In another example of any of the foregoing systems, the assembly is a differential.

In another example of any of the foregoing systems, the assembly is an oil-water heat exchanger.

In another example of any of the foregoing systems, the assembly comprises a traction motor.

In another example of any of the foregoing systems, the path extends through a housing of the traction motor.

In another example of any of the foregoing systems, the assembly includes a housing that includes at least one channel, the at least one channel providing a portion of the path.

In another example of any of the foregoing systems, the outlet comprises a shower head.

Another example of any of the foregoing systems includes a frunk that holds the container.

Another example of any of the foregoing systems includes a pump that is activated to communicate the water along the path.

Another example of any of the foregoing systems includes a controller. The controller is commanding the pump to activate based on thermal energy in the assembly.

In another example of any of the foregoing systems, the controller commands the pump to activate based on comparison of a thermal energy stored in water within the container to thermal energy in the assembly.

A method of heating water according to yet another exemplary aspect of the present disclosure includes holding water within a container of a vehicle, and, to raise a temperature of water within the container, communicating water along a path from the container to an assembly of the vehicle, and circulating the water back to the container.

Another example of the foregoing method includes heating water at the assembly.

Another example of any of the foregoing methods includes dispensing water from the container through an outlet for use by a user.

In another example of any of the foregoing methods, the outlet is a spray nozzle.

In another example of any of the foregoing methods, the assembly of the vehicle is an oil-water heat exchanger.

Another example of any of the foregoing methods includes, during the communicating, communicating the water through a path within a cover of the assembly.

Another example of any of the foregoing methods includes activating a pump to communicate water along the path based on comparison of a thermal energy stored in water within the container to thermal energy in the assembly.

Another example of any of the foregoing methods includes powering the pump using an accessory battery and deactivating the pump in response to a state of charge of the accessory battery falling below a threshold.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

BRIEF DESCRIPTION OF THE FIGURES

The various features and advantages of the disclosed examples will become apparent to those skilled in the art from the detailed description. The figures that accompany the detailed description can be briefly described as follows.

DETAILED DESCRIPTION

This disclosure details a system for heating water that is held within a container on a vehicle. A user can take water from the container when the user is overlanding in the vehicle, for example.

Figure 1:
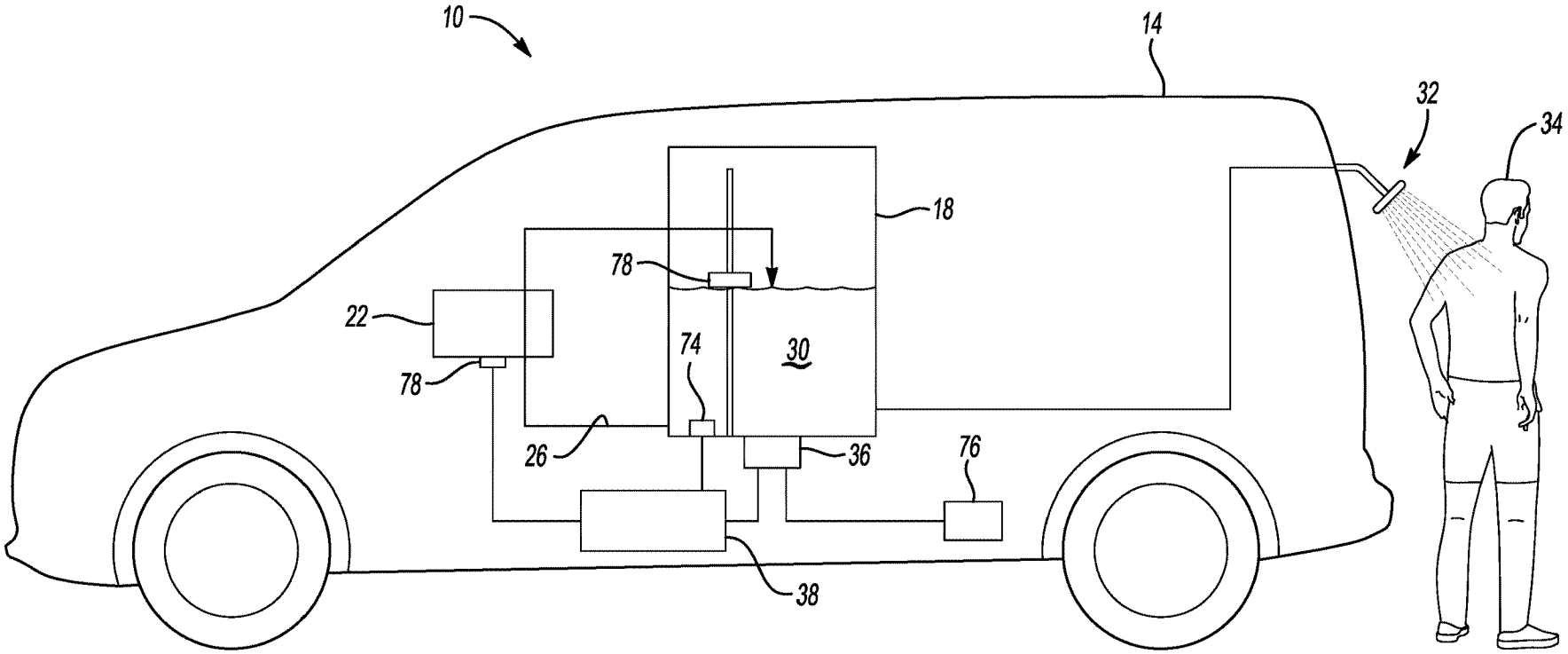
FIG. 1 shows a schematic view of a vehicle having a water heating system.

With reference to FIG. 1, a water heating system 10 for a vehicle 14 includes a container 18, an assembly 22 of the vehicle 14, and a path 26. The container 18 holds water 30.

In some examples, the vehicle 14 is an electrified vehicle and the container 18 held within a frunk of the vehicle 14. In other examples, the vehicle 14 is a conventional vehicle, and the container 18 is disposed within a rear cargo bed area.

Water 30 can be dispensed from container 18 and outside the vehicle 14 through an outlet 32, for example. A user 34 can take water 30 dispensed from the container 18 and use the water 30 for cleaning, cooking, etc. The outlet 32 can be a showerhead, for example.

The assembly 22 is an assembly having a thermal energy level that increases as a result of operating the vehicle 14. The thermal energy level increases can be due to friction, for example.

To heat the water 30, the path 26 can communicate water 30 from the container 18 to the assembly 22. At the assembly 22, thermal energy from the assembly 22 moves to the water 30, which cools the assembly 22 and heats the water 30. The water 30 heated by the assembly 22 is then communicated through the path 26 back to the container 18, which increases the thermal energy of water 30 within the container.

A pump 36 can be used to move the water 30 through the path 26. In some examples, the pump 36 can also be used to move water 30 through the outlet 32. A controller 38 can activate the pump 36 when heating the water 30 is desired and when there is enough thermal energy in the assembly 22 to heat the water 30. The water 30 within the container 18 can be heated to 140 degrees Fahrenheit in some examples.

In this example, the assembly 22 can be used to heat the water 30 within the container 18 when the vehicle 14 is operating, or when the vehicle 14 is stationary.

Figure 2:
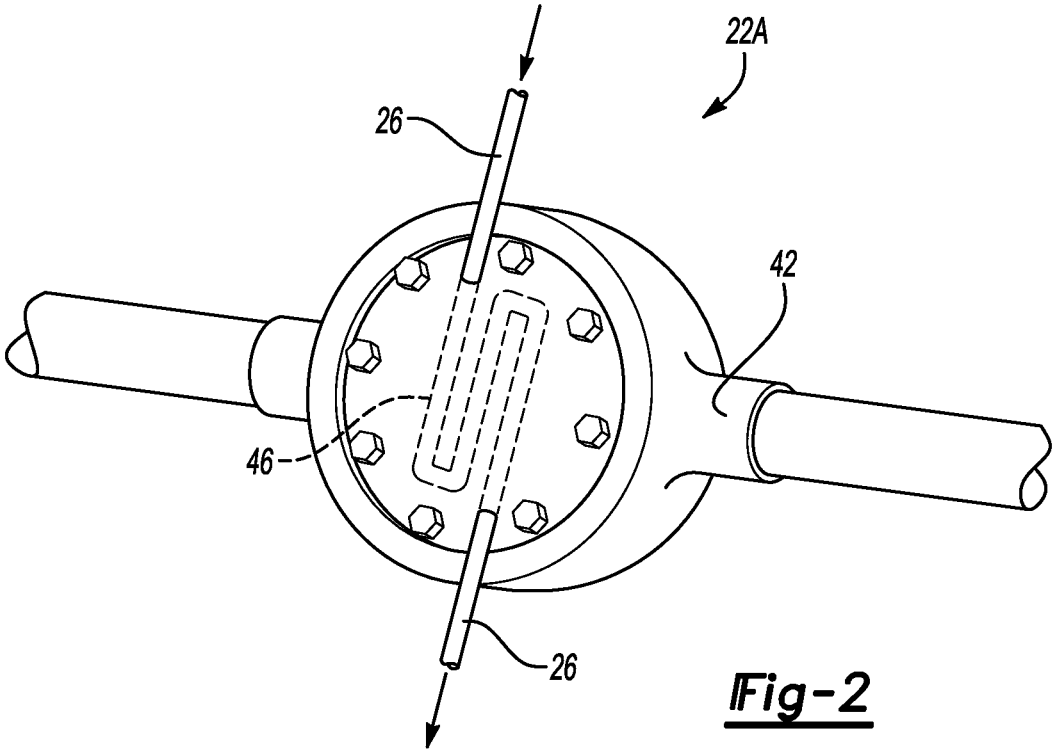
FIG. 2 shows a close-up perspective view of an assembly from the vehicle of FIG. 1 that is used to heat water.

With reference to FIG. 2 and continued reference to FIG. 1, the assembly 22 can be a transaxle 22A, for example. The transaxle 22A can include a transmission, an axle, and a differential held within a housing 42. To heat the water 30 at the transaxle 22A, the path 26 extends though the housing 42. The housing 42 containing that path 26 can be an aluminum cover that is cast or machined to include channels 46 that provide a portion of the path 26. The housing 42 heats up when the vehicle 14 is operated. Water 30 communicating along the path 26 through the channels 46 can take on thermal energy from the housing 42.

Figure 3:
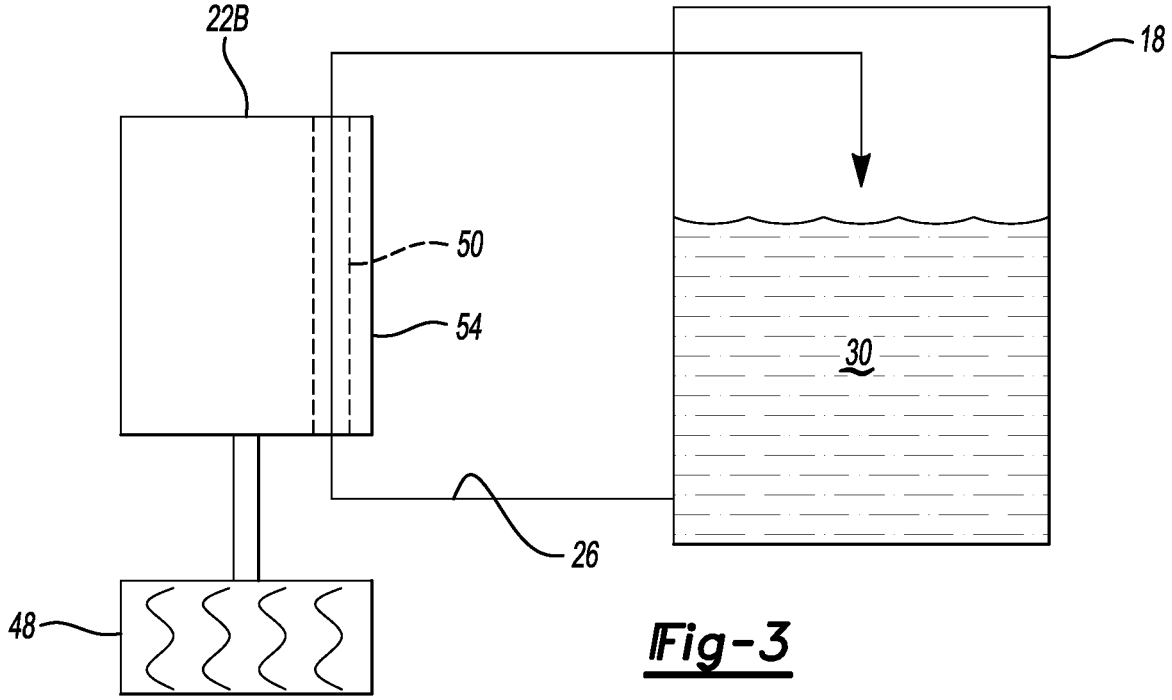
FIG. 3 shows a schematic view of another assembly that could be used to heat water in another embodiment of the water heating system of FIG. 1.

With reference to FIG. 3 and continued reference to FIG. 1, in another example, the assembly 22 is a traction motor 22B that is used to drive at least one wheel 48 of the vehicle 14. To heat the water 30 at the assembly 22B, the path 26 extends through a channel 50 within a housing 54 of the traction motor 22B, such as a bolt-on cover of the housing 54. Thermal energy levels within the housing 54 increase when the traction motor 22B is operated.

Figure 4:
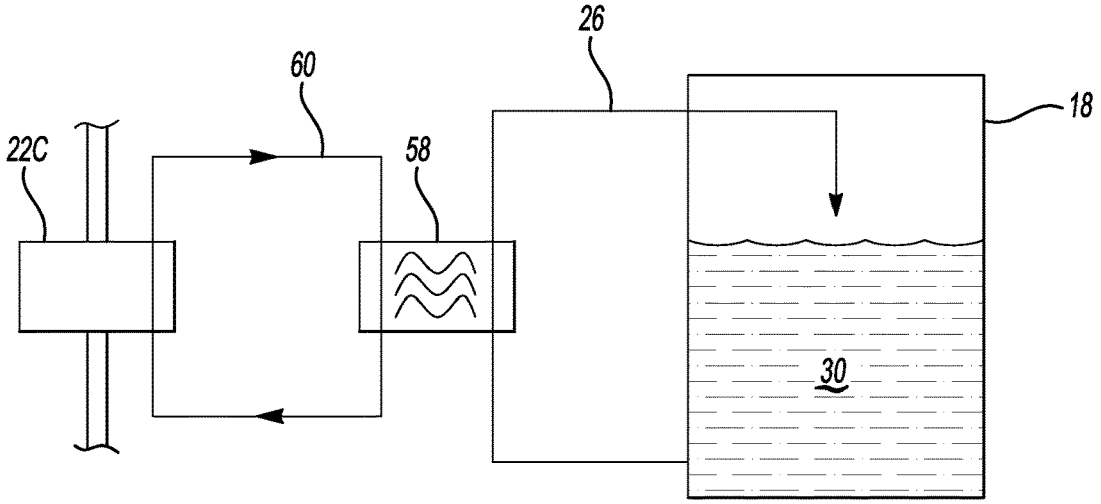
FIG. 4 shows a schematic view of another assembly that could be used to heat water in yet another embodiment of the water heating system of FIG. 1.

With reference now to FIG. 4 and continued reference to FIG. 1, the assembly 22 includes both a transaxle 22C and an oil-water heat exchanger 58. Oil is circulated between the transaxle 22C and the heat exchanger 58 and long a path 60. The path 26 along which water 30 from the container 18 passes, also extends through the heat exchanger 58. At the heat exchanger 58, thermal energy from the oil communicating through the path 60 is transferred to the water 30 that is communicating along the path 26.

Referring again to FIG. 1, the controller 38 of the vehicle 14 can selectively activate of the pump 36 to move water 30 along the path 26. The controller 38 can communicate with the pump 36 via wireless communications, such as Bluetooth Low Energy communications. The controller 38 can receive inputs from, among other things, a tank temperature sensor 74 and an assembly temperature sensor 78.

If, for example, inputs to the controller 38 indicate that a temperature of water 30 in the container 18 is significantly less than a temperature of the assembly 22, the controller 38 can activate the pump 36 to circulate water 30. This raises a temperature of water 30 in the container 18 and lowers a temperature of the assembly 22. In some examples, the temperature of the assembly 22 can be estimated rather that sensed using the assembly temperature sensor 78. The estimate of temperature of the assembly 22 based on, for example, an operation time of the vehicle 14 and how long the assembly 22 has been operating.

The exemplary controller 38 is thus commanding the pump 36 to activate based in part on a thermal energy within the assembly 22 and, more particularly, based on comparison of a thermal energy stored in water 30 within the container 18 to thermal energy in the assembly 22.

In this example, the pump 36 is powered by a 12-Volt accessory battery 76 when the pump 36 is activated. The example pump 36 can draw from two to three amps during operation.

The controller 38 can receive an input corresponding to a state-of-charge of the sensor 74. If the state-of-charge falls below a threshold, say 50%, the controller 38 can command the pump 36 to deactivate. This can help to avoid the pump 36 draining the battery 76 to a state-of-charge that is undesirably low.

The controller 38, in some examples, can also receive an input from a level sensor 76 associated with the container 18. This input tells the controller 38 how much water 30 is held by the container 18. The controller 38 may transmit an alert to a user if the amount of water within the container 18 falls below a threshold amount.

The controller 38, in some examples, can receive an input from a user corresponding to a desired temperature for the water 30 within the container 18. The user may input a desired temperature through a touch screen of the vehicle 14, for example.

The controller 38 may activate the pump 36 in response to the user adding water to the container 18. The added water may be colder than desired by the user. The controller 38 can activate the pump 36 to heat water 30 within the container 18 until the temperature of the assembly 22 is nominally equal to a temperature of the water 30 within the container 18. At that point, continued circulation to the assembly 22 will no longer heat the water 30.

When the vehicle 14 is parked, the controller 38 can monitor temperatures when the vehicle 14 is stationary and predict when a temperature of the water 30 within the container 18 will fall below 120 degrees Fahrenheit, which is typically considered the lower boundary of what would be considered "hot" water. The controller 38 can activate the pump 36 in response to maintain a temperature of the water 30 above this threshold. The controller 38 can also factor in a prediction of how much the vehicle 14 must be operated to maintain the assembly 22 at a temperature sufficient to heat the water 30.

The controller 38, in this exemplary embodiment, includes a processor and a memory portion. The controller 38 can be a stand-alone controller or incorporated into another controller of the vehicle 14. Although schematically shown as a single hardware device, the controller 38 could include multiple controllers in the form of multiple hardware devices, or multiple software controllers within one or more hardware devices. At least some portions of the controller 38 could, in some examples, be located remote from the vehicle 14.

The processor of the controller 38 can be programmed to execute a program stored in the memory portion. The processor can be a custom made or commercially available processor, a central processing unit (CPU), an auxiliary processor among several processors associated with the controller 38, a semiconductor-based microprocessor (in the form of a microchip or chip set) or generally any device for executing software instructions.

The program can be stored in the memory portion as software code. The memory portion can include any one or combination of volatile memory elements and/or nonvolatile memory elements. The program stored in the memory portion can include one or more additional or separate programs, each of which includes an ordered listing of executable instructions for implementing logical functions associated with, among other things, controlling the pump 36 and monitoring temperatures.

Figure 5:
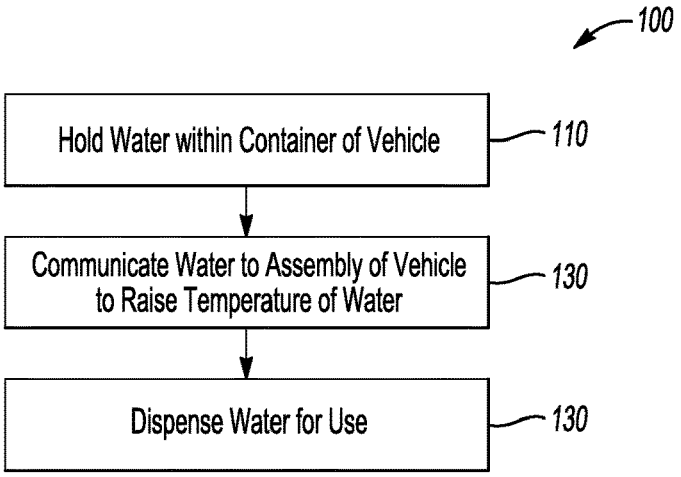
FIG. 5 shows the flow of an exemplary method of heating water within the vehicle of FIG. 1.
Figure 6:
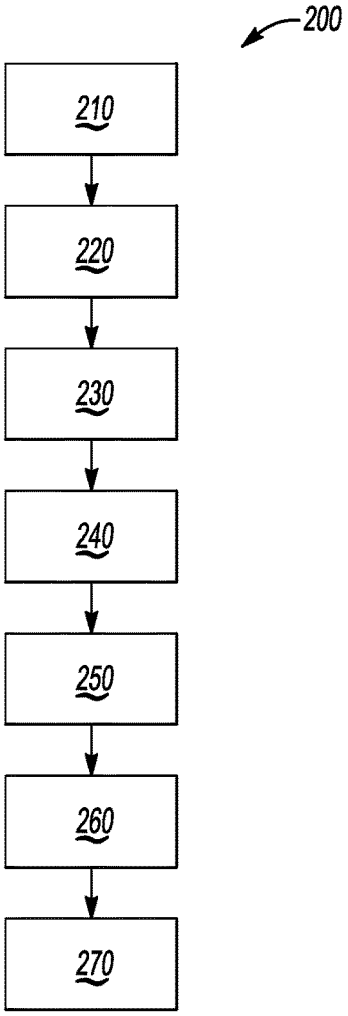
FIG. 6 shows the flow of a method of monitoring and heating water within the vehicle according to another exemplary aspect or the present disclosure.

With reference to FIG. 5, a flow of exemplary method 100 of heating water can be executed by the controller 38. The method 100 includes a step 110 of holding water within a container of a vehicle. Next, at a step 120, to raise a temperature of water within the container, the method 100 communicates water along a path from the container to an assembly of the vehicle, and then circulates the water back to the container. The step 120 raises a temperature of water within the container because the assembly heats the water, and this heated water is reintroduced to the container.

In this example, the method 100 additionally includes a step 130 of dispensing water from the container through an outlet for use by a user. The outlet can be a spray nozzle, such as a showerhead.

The flow of another example method 200 of monitoring and heating water can be executed by the controller 38. The method 200 starts at a step 210. Next at a step 220, the method 200 monitors an amount of water within the container, and, over time estimates an average water user per day and how long before the container will be empty. If a water level in the container rises and the vehicle speed is zero, the controller 38 can interpret that the user is filling the container. In response, the controller 38 can reset a water use flag and restart use calculations.

At a step 230, the method 200 at a set time of day, monitors an amount of water used during the previous day and updates a calculation that predicts how many more days water can be taken from the container without running out.

At a step 240, if the temperature of water in the container is less than a temperature of a vehicle assembly, say a differential, the method 200 activates a pump to circulate water between the container and the assembly. The controller may not activate the pump at the step 216 is there is too little water in the container, say less than ten-percent of an overall capacity of the container.

At a step 250, the method 200 periodically rechecks the temperature of the water within the container and reports out the rechecked temperature to the user. The report can include a prediction of how long it will take until the water reaches a desired temperature set by the user. The prediction can be based on an outside temperature and an expected usage of the vehicle.

At a step 260, the method 200 monitors the amount of water within the container and, if the amount falls below a threshold, sends an alert to the user requesting that that the container be refilled. The threshold for sending the alert can be, for example, twenty-percent of an overall capacity of the container. If the amount of water falls below say ten-percent of the overall capacity, the method 200 can automatically stop the pump.

The method 200 then ends at the step 270.

Exemplary features of some of the disclosed examples includes enabling a user to select a desired temperature for water within the container. The desired temperature can be selected through the touch screen of the vehicle. A future temperature of the water within the container can be predicted. The prediction can be based on referencing a lookup table using an outside temperature and an actual temperature of the water within the container. Another feature is heating the water within the tank using the assembly, and the heating occurs when the vehicle is operating, when the vehicle is keyed off, or both.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

What is claimed is:

1. A water heating system for a vehicle, comprising:

a container;

an assembly of a vehicle, the assembly having a thermal energy level that increases as a result of operating the vehicle, wherein the assembly comprises a traction motor;

a path that communicates water back-and-forth between the container and the assembly to increase amount of thermal energy within the water that is in the container; and an outlet configured to dispense water from the container for use by a user.

2. The water heating system of claim 1, wherein the path extends through a housing of the traction motor.

3. The water heating system of claim 1, wherein the assembly includes a housing that includes at least one channel, the at least one channel providing a portion of the path.

4. The water heating system of claim 3, wherein the outlet comprises a shower head.

5. The water heating system of claim 1, further comprising a frunk that holds the container.

6. The water heating system of claim 1, further comprising a pump that is activated to communicate the water along the path.

7. The water heating system of claim 6, further comprising a controller, the controller commanding the pump to activate based on thermal energy in the assembly.

8. The water heating system of claim 7, wherein the controller commands the pump to activate based on comparison of a thermal energy stored in water within the container to thermal energy in the assembly.

9. A water heating system for a vehicle, comprising:

a container;

an assembly of a vehicle, the assembly having a thermal energy level that increases as a result of operating the vehicle;

a path that communicates water back-and-forth between the container and the assembly to increase amount of thermal energy within the water that is in the container; and an outlet configured to dispense water from the container for use by a user, wherein the assembly is a differential.

10. The water heating system of claim 9, wherein the assembly includes a housing that includes at least one channel, the at least one channel providing a portion of the path.

11. The water heating system of claim 10, wherein the outlet comprises a shower head.

12. The water heating system of claim 9, further comprising a frunk that holds the container.

13. The water heating system of claim 9, further comprising a controller, the controller commanding a pump to activate based on thermal energy in the assembly, wherein the controller commands the pump to activate based on comparison of a thermal energy stored in water within the container to thermal energy in the assembly.

14. A method of heating water, comprising:

holding water within a container of a vehicle;

to raise a temperature of water within the container, communicating water along a path from the container to an assembly of the vehicle, and circulating the water back to the container;

activating a pump to communicate water along the path based on comparison of a thermal energy stored in water within the container to thermal energy in the assembly; and powering the pump using an accessory battery and deactivating the pump in response to a state of charge of the accessory battery falling below a threshold.

15. The method of claim 14, further comprising heating water at the assembly.

16. The method of claim 14, further comprising dispensing water from the container through an outlet for use by a user.

17. The method of claim 16, wherein the outlet is a spray nozzle.

18. The method of claim 14, wherein the assembly of the vehicle is an oil-water heat exchanger.

19. The method of claim 14, further comprising, during the communicating, communicating the water through a path within a cover of the assembly.

* * * * *